United States Patent [19]

Barrett

[11] 4,429,881

[45] Feb. 7, 1984

[54] PORTABLE GOLF GAME

[76] Inventor: Kenneth A. Barrett, 110 Pine St., Florence, Northampton, Mass. 01060

[21] Appl. No.: 298,782

[22] Filed: Sep. 2, 1981

[51] Int. Cl.[3] ..... A63B 69/36

[52] U.S. Cl. ..... 273/176 F; 273/176 B; 273/176 E

[58] Field of Search ..... 273/176 B, 176 E, 176 F, 273/176 FA, 176 FB, 176 G, 177 R, 87 B, 87 C

[56] References Cited

U.S. PATENT DOCUMENTS

| | | | |
|---|---|---|---|
| 2,794,646 | 6/1957 | Knott | 273/176 F |
| 2,827,299 | 3/1958 | Dean | 273/176 F |
| 3,868,111 | 2/1975 | Schuelke | 273/87 C |
| 4,098,507 | 7/1978 | Hudon | 273/176 B X |

*Primary Examiner*—George J. Marlo
*Attorney, Agent, or Firm*—Leonard S. Michelman

[57] ABSTRACT

A miniature golf course including a perimeter fence made of hinged segments of blocks that are slightly higher than the diameter of the golf ball. There is a center section having a tunnel member in the rear thereof and another tunnel member in the front opposite the starting area. Within the center section is a removable ramp having simulated traps. On each side of the center section are fences parallel to the outside perimeter fences connected to each corner of the tunnel members. Pegs and openings within the members to receive the pegs enable the center section to be quickly and easily assembled. Three fairways are formed, one on each side of the center section, and one through the center section. A single target hole is located between the rear tunnel member and the rear of the perimeter fence. A blocking member is movable and adapted to be located to close off two fairways by connecting it to a corner of the front tunnel and the perimeter fence opposite the starting area. Triangular blocking members to create hazards in the path of the ball may be set into place at predetermined locations in each fairway. By changing the positions of the blocking member and changing the locations of the triangular blocking members a minimum of 18 different arrangements are available to play an eighteen hole game of golf. Each segment utilizes hinges and/or grooves and tongues, and/or pegs and openings to assemble the perimeter fences and the center section.

15 Claims, 27 Drawing Figures

PORTABLE GOLF GAME

This invention is concerned with a novel portable miniature golf game that may be set up to play 18 different holes and which can be packaged or carried in a container of 10"×20"×42."

It is a principal object of the within invention to set up a golf course in a space no larger than 8'×6' on a flat indoor surface.

It is yet another object of this invention to provide component parts that can be folded into small members for convenient disassembly and packaging by the use of strap hinges.

It is still another object of the invention to use a novel arrangement of the folded straps hinged parts to be able to set up the golf course quickly and with simplicity.

The invention also features a gold course having the shape of a rectangular area with three (3) fairways. A common green and hole services each fairway. A full size putter is used to play the game with a full size golf ball.

Another novel feature of the invention is the use of triangular ball deflectors which are fastened to novel means on the outside railings for creating the equivalent of obstacles such as hazards to make the playing of the fairways more difficult.

Another feature of the invention is the use of color coding for the arranging of the component parts to set up the golf course in preparation of playing on same.

For a more detailed description of the invention, reference is made to the following specification, and the drawings, in which:

FIG. 19 is a view in perspective showing one of many arrangements of the various components as shown in the set up of the fairways as in the various views of FIGS. 1–18.

Figure 1:
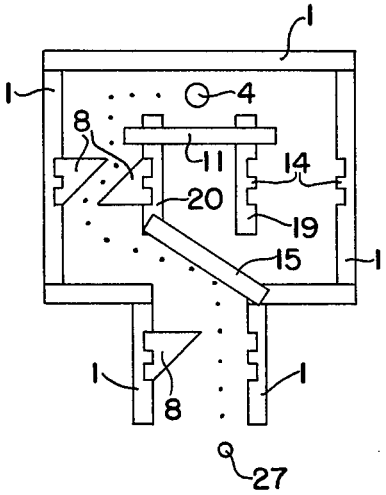
FIG. 1 is a top plan view of the game in schematic of the first hole of the golf course.

The railing or side wall 1 surrounds the outer perimeter of the playing area. The longer sides 1 are fastened together by the straps 2 which act as hinges at the ends 9.

These parts are color coded so that they are interconnected with the proper sized dimension railings 1 to form an integrated outer perimeter. In the back railing there is a tongue and groove configuration 3 for locking the rear wall components together. This arrangement is located proximate the golf hole 4.

The strap hinges 2 are recommended at four inches and made of metal, but equivalent structure would not depart from the spirit and scope of the invention. The outside railings 1 in the preferred embodiment are made of wood with dimensions of one and a half to two inches in width as can be seen at the top 10 of the railings 1. The lengths of the railing 1 vary from twenty-seven to thirty inches. They are two inches high.

Figure 23:
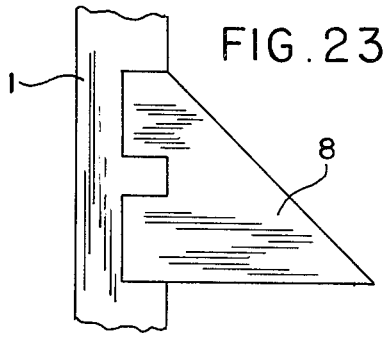
FIG. 23 is a top plan view of the triangular ball deflector locked into position on the outer railing.
Figure 24:
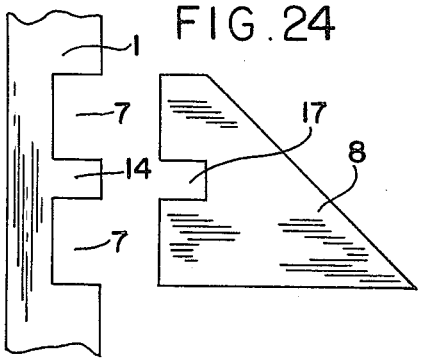
FIG. 24 is an exploded top plan view of the triangular ball deflector disengaged from the outer railing.

On the inside of the side railings 1 is a recessed groove 7 which forms a tongue 14. A ball deflector triangular shaped block 8 has a groove 17 of the same dimension as the tongue 14. When it is desired to set up the fairway as shown in the various arrangement of FIGS. 1–18, the block 8 is set into position as shown in the view of FIG. 23. See the exploded view FIG. 24. The block 8 may be placed in various positions in any of the four locations in FIG. 19.

Figure 19:
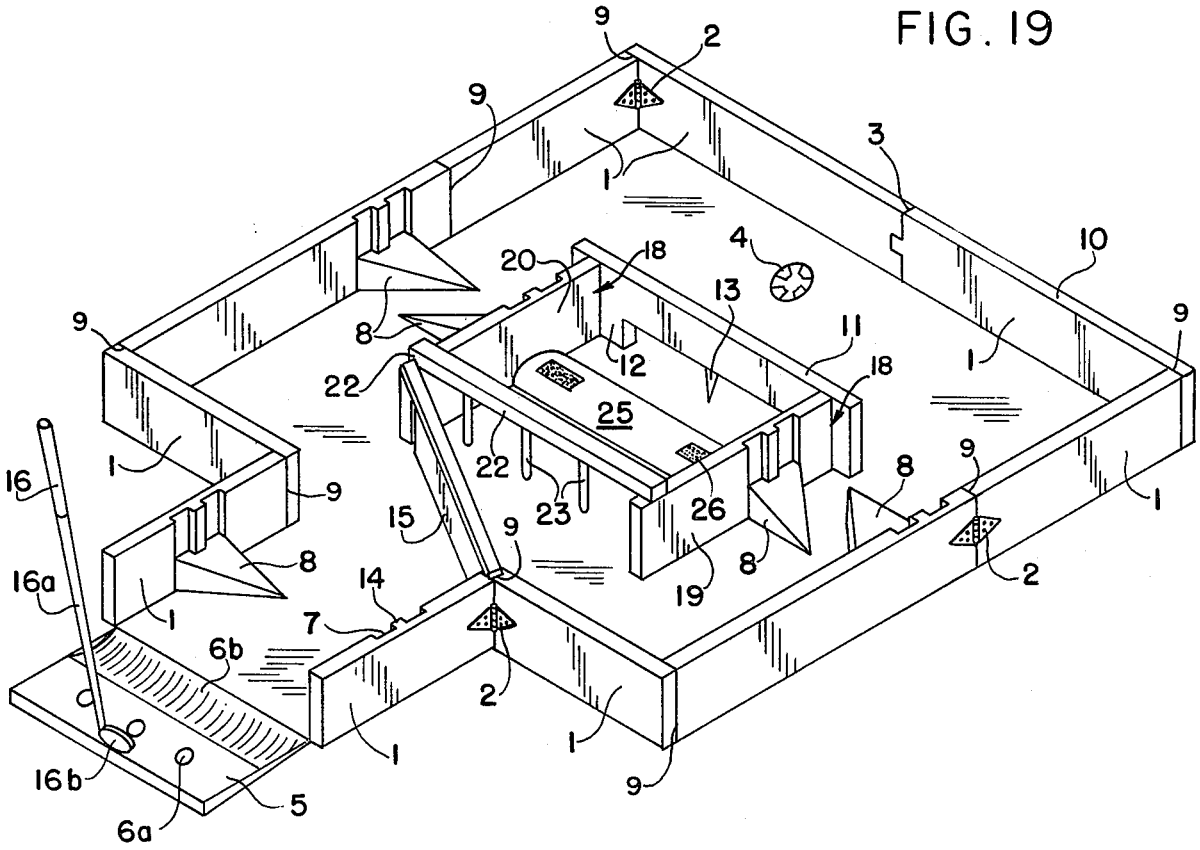
FIG. 19 is a perspective view of a hole of the course, with all parts in place.
Figure 21:
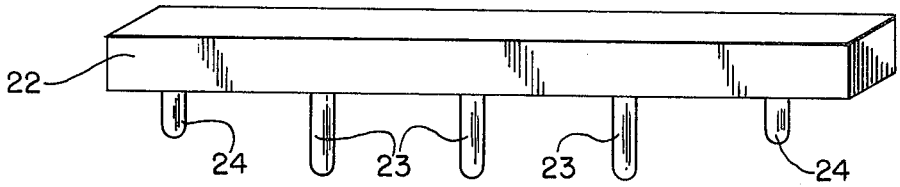
FIG. 21 is a perspective view of the horizontal tunnel component.
Figure 27:
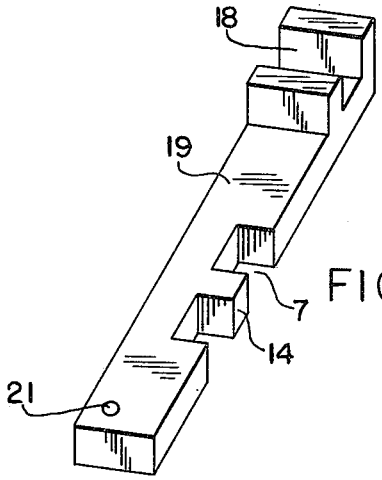
FIG. 27 is a perspective view of the right middle component.

The middle structure of FIG. 19 comprises a first horizontal tunnel member 22. There are three pegs or struts 23 extending downwardly from member 22, interspaced an equal distance from one another as shown in FIG. 21. Near the extremities of member 22 are the dowels 24. The right leg 19 of the assembly is shown in FIG. 27. Leg 19 has a circular opening 21 adapted to receive the dowel 24 of tunnel member 22. Similarly, the left leg 20 has an opening 21 adapted to receive 19.

Figure 25:
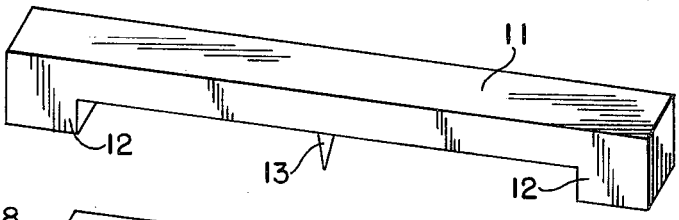
FIG. 25 is a perspective view of a second tunnel component having a strut.

The second horizontal tunnel member 11 is shown in the view of FIG. 25. It has a strut 13 extending downwardly therefrom in the middle thereof. Member 11 has the legs 12 at each end thereof so that there is an opening of a sufficient height to permit the golf ball 27 to pass thereunder when member 11 is set in place on the legs 19 and 20.

The right and left legs 19 and 20 of the middle assembly have the grooves 18 at their rear ends adapted to receive the the legs 12 of tunnel member 11.

Figure 26:
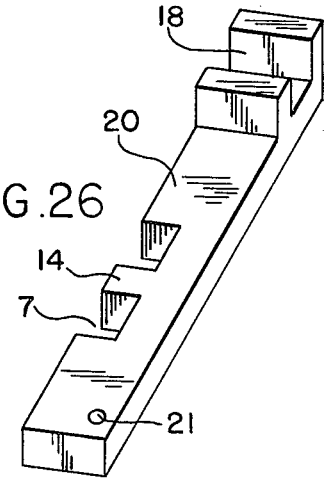
FIG. 26 is a perspective view of the left middle component.

On the outer side surface of the legs 19 and 20 are the grooves 7 and a tongue 14 adapted to receive the triangular block 8 as can be seen in the views of FIGS. 19, 26 and 27.

When members 11, 22, 19, and 20 have been connected together by interconnecting them and placing them as described and shown, there is an inner area formed. In this inner area a ramp member 25 is set down therein as shown in FIG. 19. Member 25 has a sand trap 26 at each end thereof.

Figure 22:
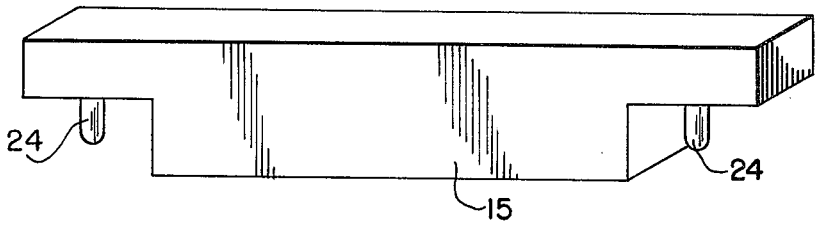
FIG. 22 is a perspective view of the rectangular ball deflector having a dowel at each end.

A horizontal ball deflector member 15 is shown in FIG. 22. It has dowels 24 located within its recessed extremities at each end thereof to permit it to be fastened to the various members to close off the middle structure from the play of the various fairways as shown in FIGS. 1, 2, 3, 7, 8, and 9, 10, 11, 12, 16, 17, and 18. FIG. 19 also shows member 15 in one of its positions. There are openings 21 in leg members 19 and 20 and the front railings 1, to receive the dowels 24 of member 15.

The ramp or tee area 5 has a depression **6*b* to alter the roll of the ball 27. A conventional putter 16 has a shaft 16*a* and a blade 16*b***.

The triangular ball deflectors 8 are cut in the shape of a pyramid with triangular surfaces, with the vertex extending into the playing area. Deflector 8 can be inserted at any of six locations. In the preferred embodiment, five deflectors 8 are employed.

Figure 20:
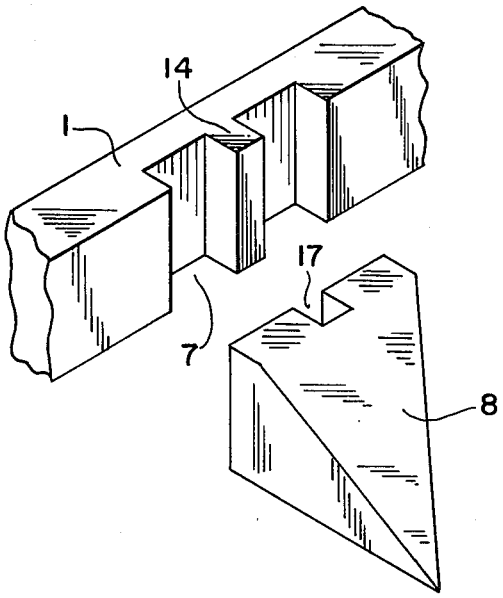
FIG. 20 is an exploded view of a portion of the side wall railing with a triangular shaped ball deflector.

Ball deflectors which are triangular and previously described as 8 in FIG. 20 are used for the purpose of making the game more tricky and requiring greater skill of the golfer.

These deflectors 8 have a base of approximately 9 inches and are approximately five and $\frac{7}{8}$ths to six inches high, with a hypotenuse of ten and a half inches.

There are the locations already described where the ball deflectors 8 are placed as can be seen from the view of FIG. 19. If the golfer wishes to go on the left hand fairway in FIG. 19 as shown, there is a ball deflector 8 which will impede the path of the ball 27 down the fairway both from the left leg of the middle section 20 and the outer railing 1 on the left hand side of the view of FIG. 20. If the player is not careful, he will have difficulty in stroking the ball between the extremities of deflectors 8, which extend into the center of the fairway. Reference is made to the views of FIG. 19, and FIGS. 1–18. There are ball deflectors 8 located, also, on the right hand wall 19 of the middle section as well as on the right hand railing 1 so that when the rectangular ball deflector 15 is changed to the various positions shown in FIGS. 1–18, the triangular ball deflectors 8 will come into play on the right hand fairway. Reference is made to various configurations of the golf course as shown in FIGS. 1–18, representing the fairways 1–18.

HOLE #1

In FIG. 1 the rectangular ball deflector 15 is located so that the middle section and the right hand fairways are blocked off. There is also a triangular ball deflector 8 located immediately at the point of starting the game in the area at 5, to the hole at 4.

HOLE #2

Figure 2:
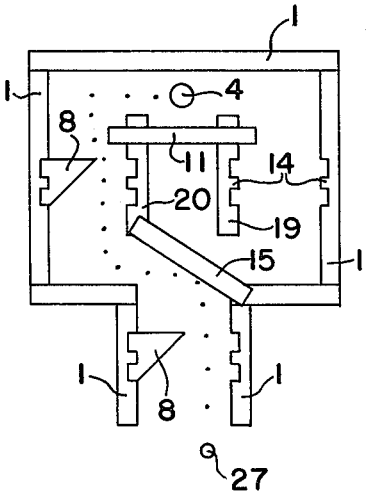
FIG. 2 is a top plan view of the game in schematic form of the second hole of the course.

In FIG. 2 the deflector 8 on the middle section left leg 20 has been removed and the ball will not have as much difficulty traveling on the left hand fairway.

HOLE #3

Figure 3:
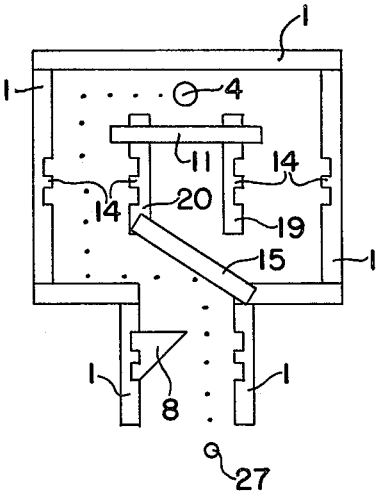
FIG. 3 is a top plan view of the game in schematic form of the third hole of the course.

In FIG. 3 the ball 27 follows the dotted lines to the left of the fairway and has no obstruction other than the deflector 8 in the area 5 at the beginning in the front left railing 1.

HOLE #4

Figure 4:
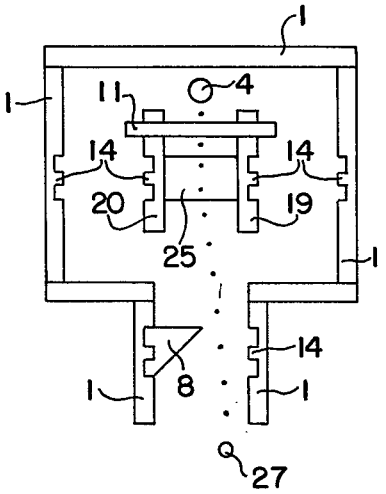
FIG. 4 is a top view of the game in schematic form of the fourth hole of the course.

It can be seen in the view of FIG. 4 that all of the triangular ball deflectors 8 have been removed except the one on the front area on the left front railing 1.

HOLES #5 AND #6

Figure 5:
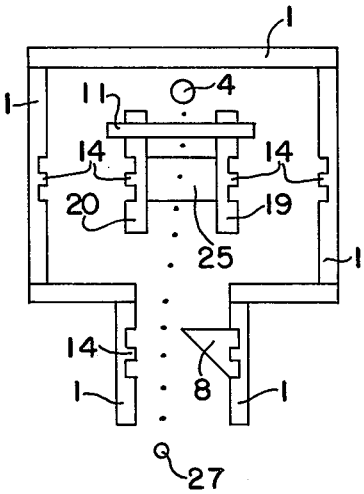
FIG. 5 is a top view of the game in schematic form of the fifth hole of the course.
Figure 6:
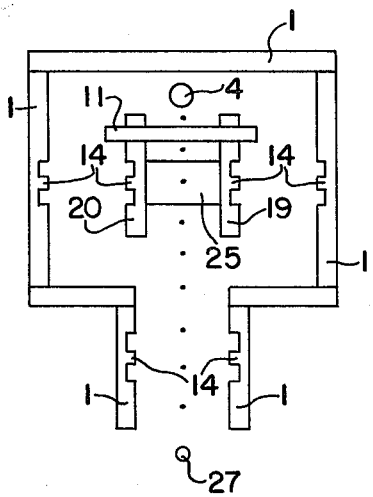
FIG. 6 is a top view of the game in schematic form of the sixth hole of the course.

FIG. 5 has changed the position of the ball deflector 8 from the left front railing 1 to the right railing 1 and the path to the hole is through the fairway in the middle section. The rectangular ball deflector 15 has been removed in the views of FIGS. 4, 5, and 6 so that there is access through the middle section (fairway). The traps at 25 and 26 are the only hazards along with the strut 13. In the holes shown in the views of FIGS. 4, 5, and 6 the left horizontal tunnel has been removed and there is no hazard that would be caused by the pegs 23.

HOLES #7, #8, AND #9

Figure 7:
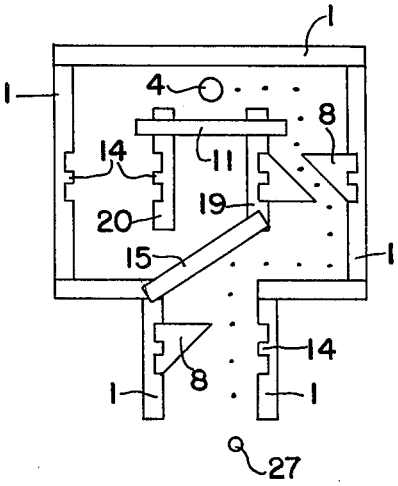
FIG. 7 is a top view of the game in schematic form of the seventh hole of the course.
Figure 8:
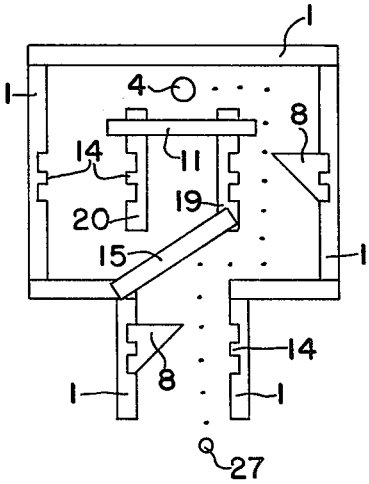
FIG. 8 is a top view of the game in schematic form of the eighth hole of the course.
Figure 9:
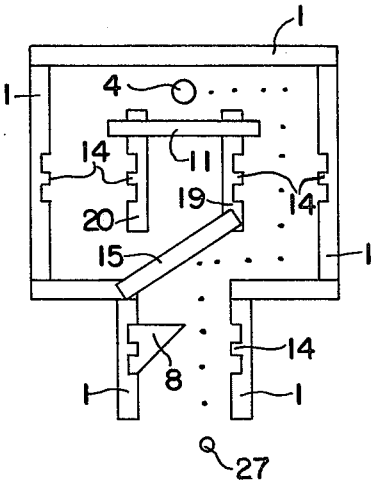
FIG. 9 is a top view of the game in schematic form of the ninth hole of the course.

Reference is made to the views of FIGS. 7, 8, and 9 which contemplate the layout of the fairways for the holes #7, #8, and #9. The ball deflector 15 is connected between the right hand leg 19 and the left hand corner railing near the front of the game 1. The triangular deflector 8 is placed on the left hand side of the front area on the railing 1. The ball 27 must, in order to travel to the hole, use the right hand side of the fairway between the two triangular ball deflectors 8. FIG. 7 (Hole #7) is a flip over of the arrangement shown in FIG. 1.

Similarly, FIG. 8 (Hole #8) employs the right hand side but the inside deflector 8 has been removed.

FIG. 9 (Hole #9) is a similar arrangement as the view of FIG. 8 but both of the deflectors 8 have been removed. The ball 27 must travel in FIGS. 7, 8, and 9 along the path of the dotted lines to gain access to the hole 4.

Figure 10:
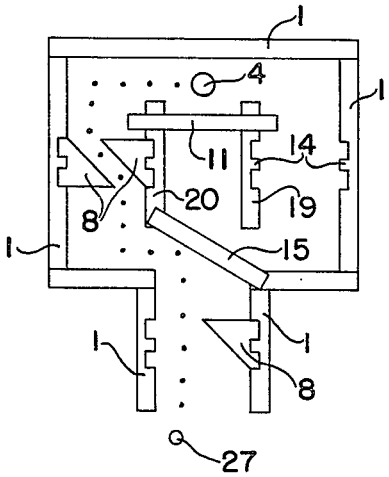
FIG. 10 is a top view of the game in schematic form of the tenth hole of the course.
Figure 11:
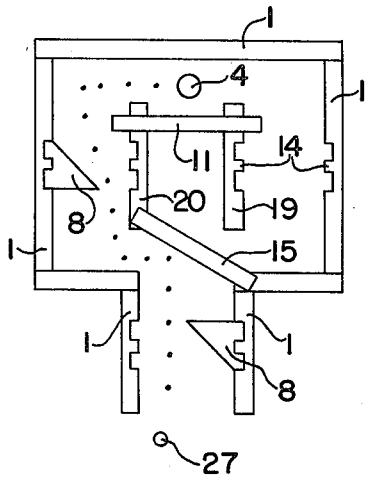
FIG. 11 is a top view of the game in schematic form of the eleventh hole of the course.
Figure 12:
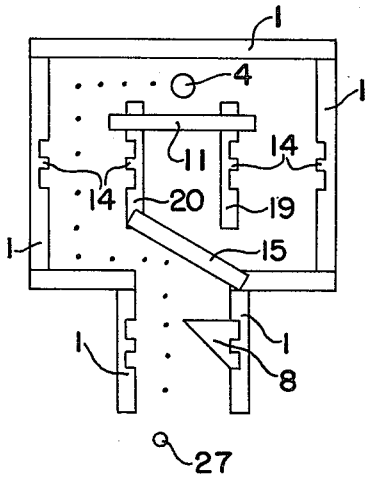
FIG. 12 is a top view of the game in schematic form of the twelfth hole of the course.
Figure 13:
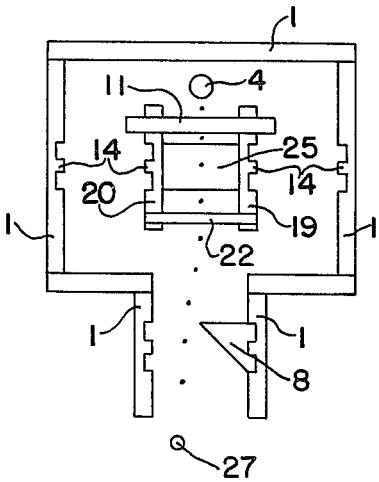
FIG. 13 is a top view of the game in schematic form of the thirteenth hole of the course.

Reference is now made to the back nine holes of the golf course and the views of FIGS. 10, 11, and 12.

HOLES #10, #11, AND #12

The ball 27 takes a path on the left side of the fairway in the view of FIG. 10. The difference between FIG. 10 and FIG. 1 is that the ball deflector 8 in the front near the area five is located on the right hand side of the railing 1 instead of the left hand side.

The ball 27 travels the path indicated by the dotted lines in FIG. 10 to the hole 4 between the two deflectors 8.

In FIG. 11, which is the layout for the eleventh hole of the golf game, the inside deflector 8 has been removed, and the hole is similar otherwise to the tenth hole shown in FIG. 10.

In the view of FIG. 12, which is the layout for the twelfth fairway, the deflectors 8 have both been removed on the left side of the fairway, and the ball 27 takes the route shown by the dotted line to the hole 4.

HOLES #13, #14, AND #15

Reference is now made to the views of FIGS., 13, 14, and and 15 which show the layout for the fairways for the thirteenth, fourteenth, and fifteenth holes respectively.

In these views the rectangular ball deflector 15 has been removed. The triangular ball deflectors 8 have also been removed from both sides of the fairway and there is only one in position on the right side of the view of FIG. 13 near the area at 5 where the ball and play commences. The member 22 is now in place and the pegs 23 act as hazards along with the trap 26 and the strut 13 as well as the rise of the member 25. The ball in the view of FIG. 14 travels the path as shown in the dotted lines.

Figure 14:
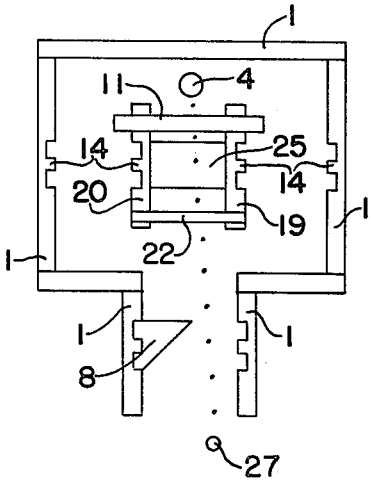
FIG. 14 is a top view of the game in schematic form of the fourteenth hole of the course.
Figure 15:
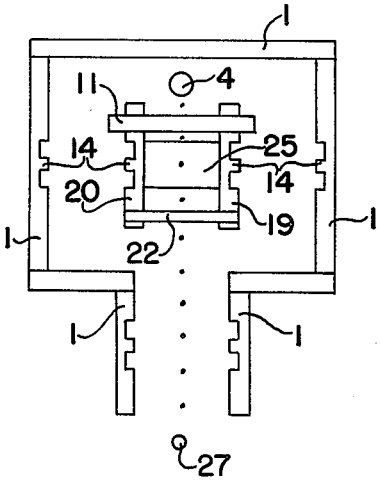
FIG. 15 is a top view of the game in schematic form of the fifteenth hole of the course.

FIG. 15 is similar to FIG. 14 except that the triangular ball deflector 8 has been removed completely. FIG. 15 has for its only hazards, the first horizontal tunnel member 22, the pegs extending therefrom 23, the ramp 25 with the traps 26, and the strut 13.

Reference is made to the view of FIG. 19. When 15 has been removed from the view of FIG. 19 and when 8 has been removed near the front area at 5 from FIG. 19, the layout will be quite similar through the middle of the fairway as that shown in FIG. 15. In explaining this specification, reference should be made continually to the view of FIG. 19 so that one can understand the various parts that are added and removed, from the fairways to layout the various holes.

HOLES #16, #17, AND #18

Figure 16:
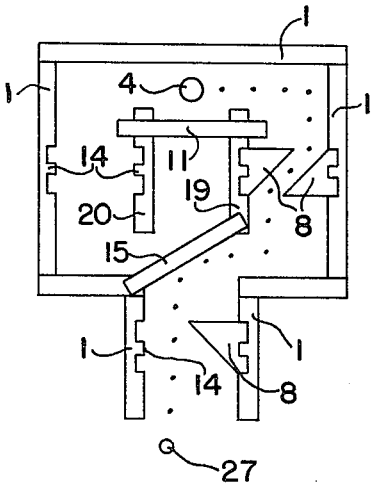
FIG. 16 is a top view of the game in schematic form of the sixteenth hole of the course.
Figure 17:
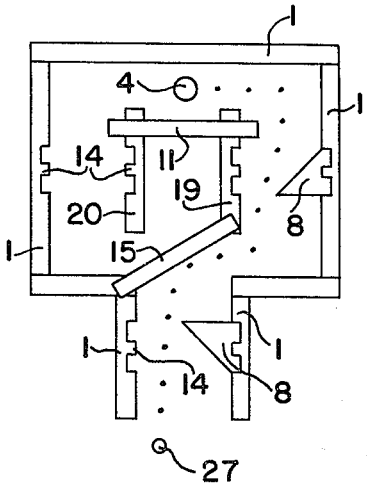
FIG. 17 is a top view of the game in schematic form of the seventeenth hole of the course.
Figure 18:
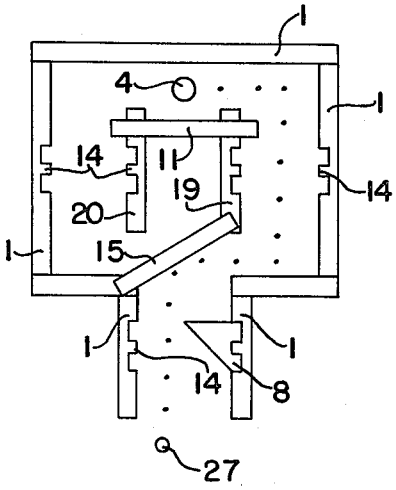
FIG. 18 is a top view of the game in schematic form of the eighteenth hole of the course.

Reference is now made to the views of FIGS. 16, 17, and 18 which represent the sixteenth, seventeenth, an eighteenth fairways of the golf game.

In the view of FIG. 16, the horizontal ball deflector or blocker 15 is connected from the right leg of the middle section 19 to the left hand corner of the front railing 1. The ball 27 now must take the path shown in the dotted lines from around the triangular deflector 8 between the two deflectors 8 mounted on the right hand fairway to the hole 4. The other components are excluded from play.

In the view of FIG. 17, which is the seventeenth fairway, the inside triangular deflector 8 on the left hand side of the fairway as shown in FIG. 16 has been removed so that there is only one deflector 8. The ball 27 travels the path of the dotted lines on the right hand side of the fairway into the hole 4.

In the view of FIG. 18, which is the eighteenth hole, there are no triangular deflectors 8. Both have been removed. There is only the deflector 8 at the front area. The ball 27 travels the path of the dotted lines to the hole 4.

The view of FIG. 19 is still a different arrangement of the components from those shown in the various holes 1–18 of the golf game.

While it is suggested in playing this game that the arrangement of the parts be made for the various holes as shown in FIGS. 1–18, it is comtemplated that if the participants want to have the opportunity to play twenty-seven or thirty-six holes of golf with different layouts of the fairways, they need only change the movable parts and the ball deflectors 8 and obstructors 15 and there can be as many holes as geometrically possible with the limited number of five ball deflectors 8 and six places to locate them as well as to rearrange the middle section components, removing the traps, inserting the traps at 26, changing the position of the ball obstructor 15 or removing it, removing the first horizontal tunnel member 22 or leaving it. It is also contemplated that the member 11 may be removed, and the strut 13 will cease being a hazard.

It is within the spirit and scope of this invention that the parts may be changed in design so that they need not be triangular such as the ball deflectors 8.

It is also within the spirit and scope of this invention that the suggested material may be substituted for a light weight metal or plastic, or some other equivalent.

The hole 4 is a circular piece of light metal with a plurality of flexible tilting tongues, enabling the ball 27 to roll up and into the flat part and be retained therein.

PORTABILITY

The components described are easily disassembled for storage or packaging. A container 10 inches by 20 inches by 42 inches is employed in the preferred embodiment. The left fence 1 is folded up like an accordian. There are five pieces of fence 1 conected together by the straps 2. When folded, they are parallel to one another. When opened, they form the the fence on the left side of FIG. 19. Similarly, the right side is folded up on the hinges 2 so that the five pieces of the fence are parallel. Each fence is placed on top of the other in the box. The other components described are positioned on top thereof and the box is closed.

SCORING OF THE GAME

Par for the course is 54 strokes, and every hole is a "par 3" hole. Each hole should be played in no less than 3 strokes. But you can also obtain a PAR score in another way. If your *AVERAGE SCORE* for all 18 holes turns out to be 3 strokes per hole, then you have equaled par. The scoring itself is exactly like the scoring for the sport of GOLF.

To keep a record of the number of strokes on each hole, a score card is provided. The score is written down after each hole. The number of strokes for the first nine holes are added to the number of strokes for the final nine holes and the total score for 18 holes is added to determine the winner.

The names of the number of strokes for each hole is similar to regular golf.

If only 1 stroke is needed for a hole, then it is a "hole in 1." If two strokes are needed for a hole, it is a "birdie." If 3 strokes are needed for a hole, it is a "par." If 4 strokes are needed for a hole, it is a "bogie." If 5 strokes are needed for a hole, it is a "double bogie." If 6 strokes are needed for a hole, it is a "triple bogie."

RULES OF THE GAME

1. After 6 strokes on any one hole the player *MUST* pick up his/her ball and go on to the next hole.
2. IF THE BALL SKIPS OVER ANY OF THE BALL DEFLECTORS: If, in the course of play, a ball flies over any of the obstacles, it should be returned to its original position and the player MUST add 1 penalty stroke to his or her final score for that hole.
3. IF THE BALL SKIPS OVER FENCE 1: If during the course of play, the ball flies over the fence 1, the player should return it to the point where it was originally stroked and then add 1 penalty strike to the final score for that particular hole.

The game is designed so that the ball does not have to be stroked hard. If stroked properly, it should never "jump" the railing during the course of play.

4. IF THE BALL LANDS VERY NEAR A RAILING: Since the purpose of the game is not only to test one's putting abilities, but also to provide a sense of fairness during the course of play (and this cannot be done if a player is prevented from stroking the ball properly), then the ruling for a ball that is touching a railing or is less than the length of the putter's club head away is as follows:

OPTION A: The player can stroke the ball as it lies.

OPTION B: The ball can be moved the length of the putter's club head away from the railing in any direction and no penalty stroke is required.

5. IF A BALL LIES AGAINST OR VERY NEAR ONE OF THE BALL DEFLECTORS: If the ball lies against or very near one of the ball deflectors, the player has a choice of 3 options.

OPTION A: The player can putt the ball as it lies.

OPTION B: The player may choose to move the ball half the club head's length or about two inches away from the ball deflector in any direction and then stroke it with no penalty stroke involved.

OPTION C: The ball may be moved the full length of the putter's club in any direction, so that the next putt can be made comfortably, but the player must add one stroke to his or her score for that hole.

6. IF THE BALL LANDS BETWEEN TWO BALL DEFLECTORS: If the ball lands between two of the triangular ball deflectors, the player has 3 options:

OPTION A: The player can putt the ball as it lies.

OPTION B: The ball may be moved in a *backward* direction, half the club head's length or about two inches, and no penalty is involved.

OPTION C: The ball may be moved the full length of the putter's club head in a *backward* direction, so that the next putt can be made as smoothly as possible, but there is a 1 stroke penalty for doing this.

7. IF THE BALL LANDS VERY NEAR OR IS TOUCHING ONE OF THE PEGS 23 FROM WITHIN THE TWO TUNNELS IN THE MIDDLE SECTION: If the ball lands very near or is touching one of the protruding pegs 23 from either of the two tunnels in the middle section of the course, a player has the following 3 options:

OPTION A: The player can putt the ball as it lies.

OPTION B: The ball may be moved in a *backward* direction half the club head's length or about two inches, and no penalty is involved.

OPTION C: The ball may be moved the length of the putter's club head in a *backward* direction, so that the next putt can be made as smoothly as possible, but there is a 1 stroke penalty for doing this.

8. IF THE BALL LANDS IN THE SAND TRAP DEPRESSIONS 26 ON THE RAMP 25: If the ball lands in either of the sand trap depressions 26 on the ramp 25, the player MUST remove it. The ball should then be placed a full putter's club head's length *behind the ramp* 25 and the can be continued from that point on. At the end of the hole the player must add 1 penalty stroke to his or her score for that hole.

9. STARTING THE BALL IN PLAY FOR EACH HOLE: The player has a choice of starting the ball in play from one of two surfaces:

OPTION A: The player can use the red colored putting "tee" *6a* that comes with the game. If it is used, it should be placed near the edge of the left and right front railings.

OPTION B: The player can stroke the first putt on the surface behind the front railings. A piece of common chalk is included with the game so that a light line might be made in a horizontal direction from the tip of one railing to the tip of the other. It serves as a visible starting line and can be easily dusted off at the end of the game.

10. PUTTERS AND GOLF BALLS: A player has the option of using either the putter that goes with the game or any other putter that is personally owned or borrowed. If a player is putting alone and no "contest" is being held to determine who is the best player in the group, then the player has the option of using either a regular golf ball *or* the golf size whiffle ball. Both are included with the game for increased fun and variety. However, if 2 or more players are competing against each other, the same type ball must be used throughout the game. Choose either the regular golf ball or the whiffle ball at the start. No switching is allowed after the first stroke is made.

If younger children are playing the game in the living room or family den, the parents should determine which type of ball can be used most safely.

In consideration of the foregoing:

I claim:

1. A portable golf game comprising of an outer perimeter fence formed in the shape of a rectangle, consisting of modular rectangular blocks hinged together by strap means on each side thereof and of a height to contain a conventional golf ball, a starting area having a rectangular block fence on each side connected to the perimeter fence, an opening in said perimeter fence whereby a golf ball may enter within the perimeter of said fence from the said starting area, a tongue and groove means for interconnecting the perimeter fence to the rear of the rectangular block of the starting area, a middle section located within the center area of the inside of said perimeter fence, said middle section having a first tunnel board parallel to the rear fence, a left leg parallel to the left outside fence, a right leg parallel to the right outside fence, said right leg and said left leg connected to said tunnel board, and of the same height as said outside fence, means for rigidly securing said legs to said tunnel board, whereby three fairways are formed, and a circular plate of the size of a golf ball simulating a hole whereby the ball may be contained therewithin, said perimeter fence being in five hinged connected segments on each side thereof whereby said sections may be folded up and stored in a small area adapting same to being easily assembled, disassembled and carried out to different locations.

2. A portable golf game as described in claim 1 wherein the means for connecting the left and right side sections of the fence comprises of a tongue located in the rear segment of one side section and a groove located in the rear segment of the the other side section adapted to interconnect one with the other.

3. A portable golf game as recited in claim 2 having a plurality of tongues and grooves located on the inside surfaces of the perimeter fence, and also on the outside surfaces of the left and right legs of the middle section, a plurality of triangular shaped ball deflectors having tongues and grooves therein adapted to engage the tongue and grooves of said fence and legs whereby when said deflectors are employed, they create hazards and obstacles on the fairways of the golf game.

4. A portable golf game as described in claim 3 having a rectangular ball deflector, means whereby said deflector is connected on one end of the second tunnel board and to the opposite corner of the rectangular block at the starting area so that two of the three fairways are blocked off and the ball can only take the path in the open fairway to the said hole.

5. A portable golf game as described in claim 3 having a ramp in the middle section, said ramp having a trap at each end thereof so as to create a hazard in the play of the ball in the middle fairway.

6. A portable golf game as described in claim 2 having a rectangular ball deflector, means whereby said deflector is connected on one end of the second tunnel board and to the opposite corner of the rectangular block at the starting area so that two of the three fairways are blocked off and the ball can only take the path in the open fairway to the said hole.

7. A portable golf game as described in claim 6 having a ramp in the middle section, said ramp having a trap at each end thereof so as to create a hazard in the play of the ball in the middle fairway.

8. A portable golf game as described in claim 2 having a ramp in the middle section, said ramp having a trap at each end thereof so as to create a hazard in the play of the ball in the middle fairway.

9. A portable golf game as recited in claim 1 having a plurality of tongues and grooves located on the inside surfaces of the perimeter fence, and also on the outside surfaces of the left and right legs of the middle section, a plurality of triangular shaped ball deflectors having tongues and grooves there in adapted to engage the tongue and grooves of said fence and legs whereby when said deflectors are employed, they create hazards and obstacles on the fairways of the golf game.

10. A portable golf game as described in claim 9 having a ramp in the middle section, said ramp having a trap at each end thereof so as to create a hazard in the play of the ball in the middle fairway.

11. A portable golf game as described in claim 9 having a second tunnel board and a rectangular ball deflector, means whereby said deflector is connected on one end of the rectangular block at the starting area so that two of the three fairways are blocked off and the ball can only take the path in the open fairway to the said hole.

12. A portable golf game as described in claim 11 having a ramp in the middle section, said ramp having a trap at each end thereof so as to create a hazard in the play of the ball in the middle fairway.

13. A portable golf game as described in claim 1 having a second tunnel board and a rectangular ball deflector, means whereby said deflector is connected at one end of the second board and to the opposite corner of the rectangular block at the starting area so that two of the three fairways are blocked off and the ball can only take the path in the opposite fairway to the said hole.

14. A portable golf game as described in claim 13 having a ramp in the middle section, said ramp having a trap at each end thereof so as to create a hazard in the play of the ball in the middle fairway.

15. A portable golf game as described in claim 1 having a a ramp in the middle section, said ramp having a trap at each end thereof so as to create a hazard in the play of the ball in the middle fairway.

* * * * *